US005300013A

United States Patent [19]

Frässdorf et al.

[11] Patent Number: 5,300,013

[45] Date of Patent: Apr. 5, 1994

[54] DOUBLE CENTRIFUGE FOR HIGHLY VISCOUS MATERIAL

[75] Inventors: Dieter Frässdorf; Paul H. Franzen, both of Grevenbroich, Fed. Rep. of Germany

[73] Assignee: Dorr-Oliver Deutschland GmbH, Grevenbroich, Fed. Rep. of Germany

[21] Appl. No.: 592,045

[22] Filed: Oct. 4, 1990

[30] Foreign Application Priority Data

Oct. 4, 1989 [DE] Fed. Rep. of Germany ..... 3933136

[51] Int. Cl.[5] ..... B04B 3/00

[52] U.S. Cl. ..... 494/34; 494/32; 494/35; 494/10; 494/44

[58] Field of Search ..... 494/10, 34, 37, 31, 494/32, 35, 42, 43, 44, 50, 60, 62, 63; 366/228, 176, 14, 15, 172, 168, 196, 169, 164, 165, 232, 194; 210/781

[56] References Cited

U.S. PATENT DOCUMENTS

| | | | |
|---|---|---|---|
| 617,466 | 1/1899 | Macmaster | 494/60 |
| 622,408 | 4/1899 | Aspinall et al. | 494/60 |
| 1,322,139 | 11/1919 | Schifferle | 494/43 |
| 1,401,291 | 12/1921 | Touceda | 494/60 |
| 1,974,679 | 9/1934 | Lindberg | 494/32 |
| 2,085,538 | 6/1937 | Lyons | 494/32 |
| 2,097,420 | 10/1937 | Lyons | 494/32 |
| 2,542,456 | 2/1950 | Ayres | 494/32 |
| 3,048,559 | 8/1962 | Heller et al. | 366/141 |
| 3,074,821 | 6/1963 | Laperouse | 127/63 |
| 3,079,133 | 2/1963 | Wilsman | 366/190 |
| 3,811,614 | 5/1974 | Curtin | 494/35 |
| 3,998,382 | 12/1976 | Decker et al. | 494/35 |
| 4,131,369 | 12/1978 | Gordon et al. | 366/146 |
| 4,678,646 | 7/1987 | Watanabe et al. | 366/136 |
| 4,772,400 | 9/1988 | Kreyenberg | 210/781 |

FOREIGN PATENT DOCUMENTS

| | | | |
|---|---|---|---|
| 0252341 | 1/1988 | European Pat. Off. | 494/31 |
| 0901011 | 1/1954 | Fed. Rep. of Germany | 366/176 |
| 2014519 | 10/1971 | Fed. Rep. of Germany | 494/44 |
| 2914207 | 10/1980 | Fed. Rep. of Germany | 138/104 |
| 3415519 | 10/1985 | Fed. Rep. of Germany | 494/44 |
| 3622959 | 1/1988 | Fed. Rep. of Germany . | |
| 794949 | 8/1958 | United Kingdom . | |

*Primary Examiner*—Harvey C. Hornsby
*Assistant Examiner*—Reginald L. Alexander
*Attorney, Agent, or Firm*—Herbert Dubno; Andrew Wilford

[57] ABSTRACT

A method of processing a highly viscous material comprises the steps of spinning the material in a homogenizer to reduce it to a creamy fluent consistency, flowing the creamy material wholly by gravity down into an upper centrifuge stage, centrifuging the creamy material in the upper centrifuge stage into a solids fraction and a liquid fraction, flowing the solids fraction wholly by gravity down into a lower centrifuge stage, and centrifuging the solids fraction in the lower centrifuge stage. These steps can all take continuously with the material being fed in at one end and the solid and liquid fractions obtained at the opposite lower end. Prior to spinning the material a liquid is added to it to reduce its viscosity and increase its homogeneity. This liquid can be the recirculated liquid fraction obtained in the first centrifuge stage. In accordance with this invention the recirculated liquid fraction is heated to 40° C. to 70° C. before introducing it into the homogenizer.

5 Claims, 2 Drawing Sheets

DOUBLE CENTRIFUGE FOR HIGHLY VISCOUS MATERIAL

FIELD OF THE INVENTION

The present invention relates to a centrifuge. More particularly this invention concerns a double centrifuge for a highly viscous material.

BACKGROUND OF THE INVENTION

Processing a highly viscous material such as a sugar byproduct which tends to form clumps is fairly difficult. Use of a continuous sieve-type centrifuge such as described in German patent document 3,415,519 filed 26 Apr. 1984 by Bernhard Fiedler having two stages is typically ruled out because the material forms lumps that in turn constitute offcenter masses that create so much throw as to overload the device. Such a centrifuge can only be used for relatively easy-to-handle type B sugar.

In an alternative system described in German patent document 3,622,959 filed 09 Jul. 1986 (equivalent to European patent application 252,341 published 13 Jan. 1988) also by Bernhard Fiedler the two coaxial drums are suspended from their drive motor so as to minimize offcenter vibrations. This arrangement also is not suitable for type C sugar.

Thus to separate highly viscous clump-forming suspensions such as C-sugar byproducts it is necessary to move the material manually from a single-stage centrifuge to another and to carefully load it into the downstream centrifuge. There is no known way to use a space-efficient two-stage coaxial centrifuge of the types described above.

OBJECTS OF THE INVENTION

It is therefore an object of the present invention to provide an improved system for separating a highly viscous and clump-forming suspension.

Another object is the provision of such an improved system for separating a highly viscous and clump-forming suspension which overcomes the above-given disadvantages, that is which allows the suspension to be separated in a coaxial two-stage filter centrifuge.

SUMMARY OF THE INVENTION

A method of processing a highly viscous material according to this invention comprises the steps of spinning the material in a homogenizer to reduce it to a creamy fluent consistency, flowing the creamy material wholly by gravity down into an upper centrifuge stage, centrifuging the creamy material in the upper centrifuge stage into a solids fraction and a liquid fraction, flowing the solids fraction wholly by gravity down into a lower centrifuge stage, and centrifuging the solids fraction in the lower centrifuge stage. These steps can all take place continuously with the material being fed in at one end and the solid and liquid fractions obtained at the opposite lower end.

Thus the instant invention makes it possible to treat a sugar byproduct in a two-stage centrifuge. The problem of the material clumping up and making so much throw that the centrifuge would not operate is largely ruled out by the first stage that turns it creamy and fluent. The problem of the noncentered feeding of the material to the centrifuge, which inherently makes it flow out offcenter, is also thus eliminated.

According to another feature of this invention prior to spinning the material a liquid is added to it to reduce its viscosity and increase its homogeneity. This liquid can be the liquid fraction obtained in the first centrifuge stage, recirculated back up to the homogenizer. In accordance with this invention the recirculated liquid fraction is heated to 40° C. to 70° C. before introducing it into the homogenizer.

The apparatus according to this invention has a housing, a homogenizer on the housing for spinning the material to reduce it to a creamy fluent consistency, a first conduit for flowing the creamy material wholly by gravity down into an upper centrifuge stage, an upper centrifuge in the housing for separating the creamy material into a solids fraction and a liquid fraction, a second conduit for flowing the solids fraction wholly by gravity down into a lower centrifuge stage, and a lower centrifuge below the upper centrifuge for centrifuging the solids fraction. The homogenizer includes a housing fixed on the centrifuge housing, a rotor rotatable about an upright axis in the homogenizer housing, and a drive motor beneath the rotor and operable to rotate the rotor about its axis. A drive motor atop the housing has a downwardly projecting shaft and the upper and lower centrifuges have respective upper and lower drums fixed on the shaft.

Such a structure is extremely compact and can continuously take in the material to be separated and put out the separated fractions. Normally the rotor is provided with a horizontal bottom wall perpendicular to the rotor axis, an upright side wall having an upper edge and projecting upward from the bottom wall, a top wall fixed to the side wall above the upper edge thereof and forming with the upper edge a radially open slot, and mixing formations in the rotor within the side wall. The mixing formations change the thixotropy of the inputed viscous material and greatly decrease its viscosity.

In accordance with the invention the upper edge forms a downwardly open groove and the homogenizer housing has a floor beneath the upper edge, an outer annular side wall projecting upward from the floor around the rotor, and an inner annular side wall projecting upward from the floor within the outer wall into the groove, the walls and floor together forming an annular collection compartment. In addition a spiral ramp in the compartment has a lower end and the outer side wall is formed with an outlet port at the lower end connected to the first conduit. This first conduit in turn has a tube connected to the outlet port, a transparent sight glass below the tube connected to the upper centrifuge, and a rubber cuff connected between the tube and the sight glass. This makes it possible to monitor operation of the system.

Furthermore the homogenizer housing has an input funnel receiving the untreated material and having a downwardly tapering lower end opening into the rotor beneath the upper wall thereof, and an additive line opening tangentially into the funnel. The thinning liquid is fed into this the additive line.

DESCRIPTION OF THE DRAWING

The above and other objects, features, and advantages will become more readily apparent from the following, reference being made to the accompanying drawing in which.

SPECIFIC DESCRIPTION

Figure 1:
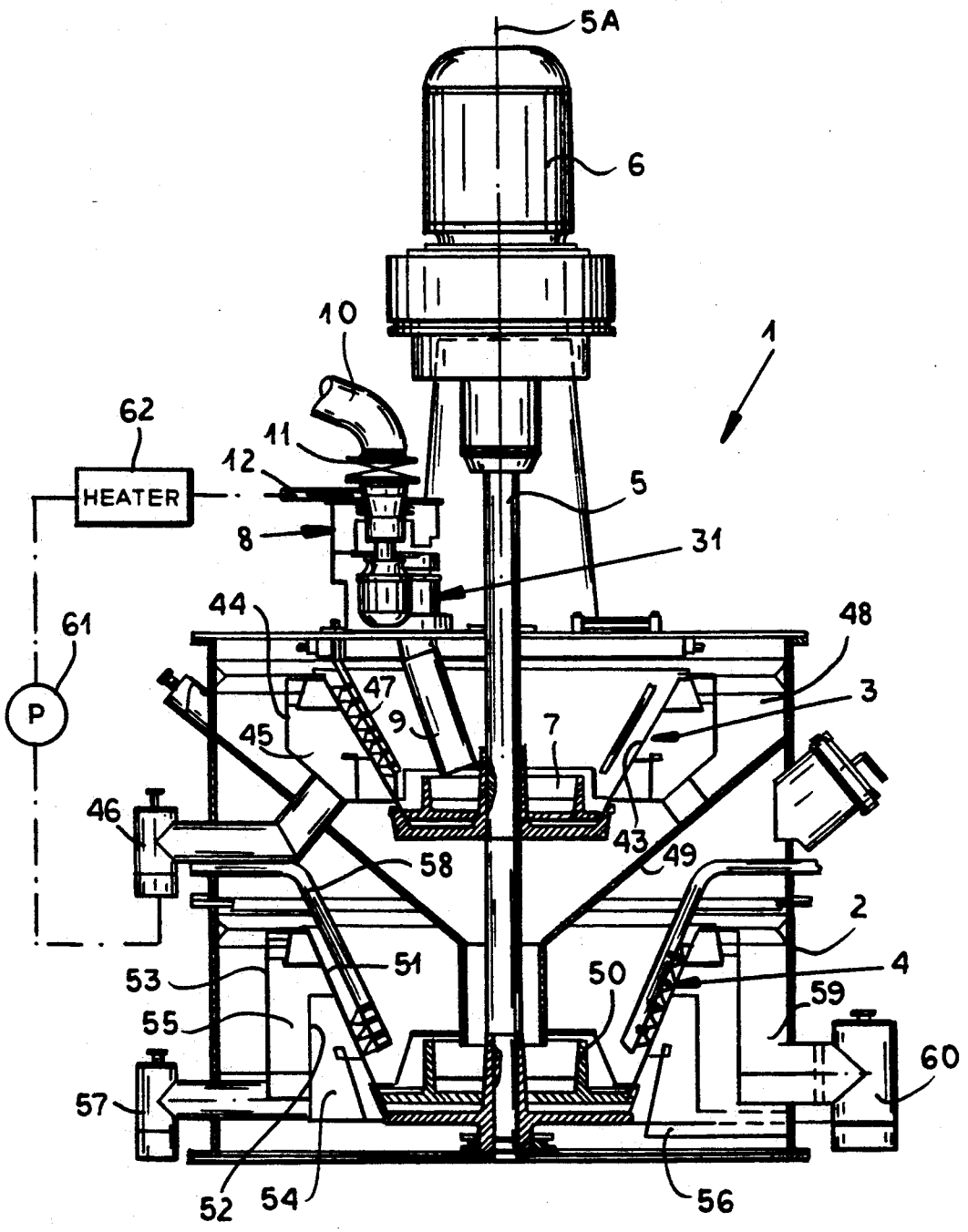
FIG. 1 is a vertical section through the centrifuge according to this invention.

As seen in FIG. 1 a centrifuge 1 according to the invention has a housing 2 in which is provided an upper primary centrifuge 3 and a lower secondary centrifuge 41 both carried on a common shaft 5 centered on a vertical axis 5A and driven by a motor 6 atop the housing 2 in the manner described in above-cited German 3,622,959. The upper primary centrifuge 3 is fitted with a preaccelerator drum 7 that receives input from a homogenizer 8 through an input tube 9 that opens into the drum of this upper centrifuge 3. In turn this homogenizer 8 receives input of material to be separated from an input pipe 10 provided with a valve 11. A secondary supply pipe 12 opening into the input line 10 immediately downstream of the flow-control valve 11 can add liquid to the inputed material to thin same if necessary.

More particularly the upper primary centrifuge 3 comprises a frustoconical foraminous drum 43 centered on the axis 5A and fixed on the shaft 5 and surrounded by a collecting wall 44 defining a first liquid-collecting compartment 45 from which leads a drain pipe 46. A pump 61 can recirculate the liquid fraction obtained in the pipe 46 to the pipe 12. A heater 62 is provided to heat this liquid to 40° C. to 70° C. prior to introduction into the homogenizer 8. Sprayers 47 are provided for washing the material that migrates up the drum 43 as it is rotated at high speed. An outer solids-collecting compartment 48 formed by a funnel-shaped wall 49 receives the solids as they are thrown from the upper edge of the drum 43 and feeds these solids into a preaccelerator 50 of a drum 51 of the lower centrifuge 4, which drum 51 is substantially identical to the foraminous drum 43. Inner and outer walls 52 and 53 surrounding the drum 51, with the wall 53 higher than the wall 52, define respective collecting compartments 54 and 55 having respective drains 56 and 57 for the liquid collected therein. Another sprayer 58 is provided for washing the solids which themselves are thrown from the top edge of the drum 51 into a compartment 59 from which they are recovered at an outlet 60. This is the system described in above-cited German 3,622,959.

Figure 2:
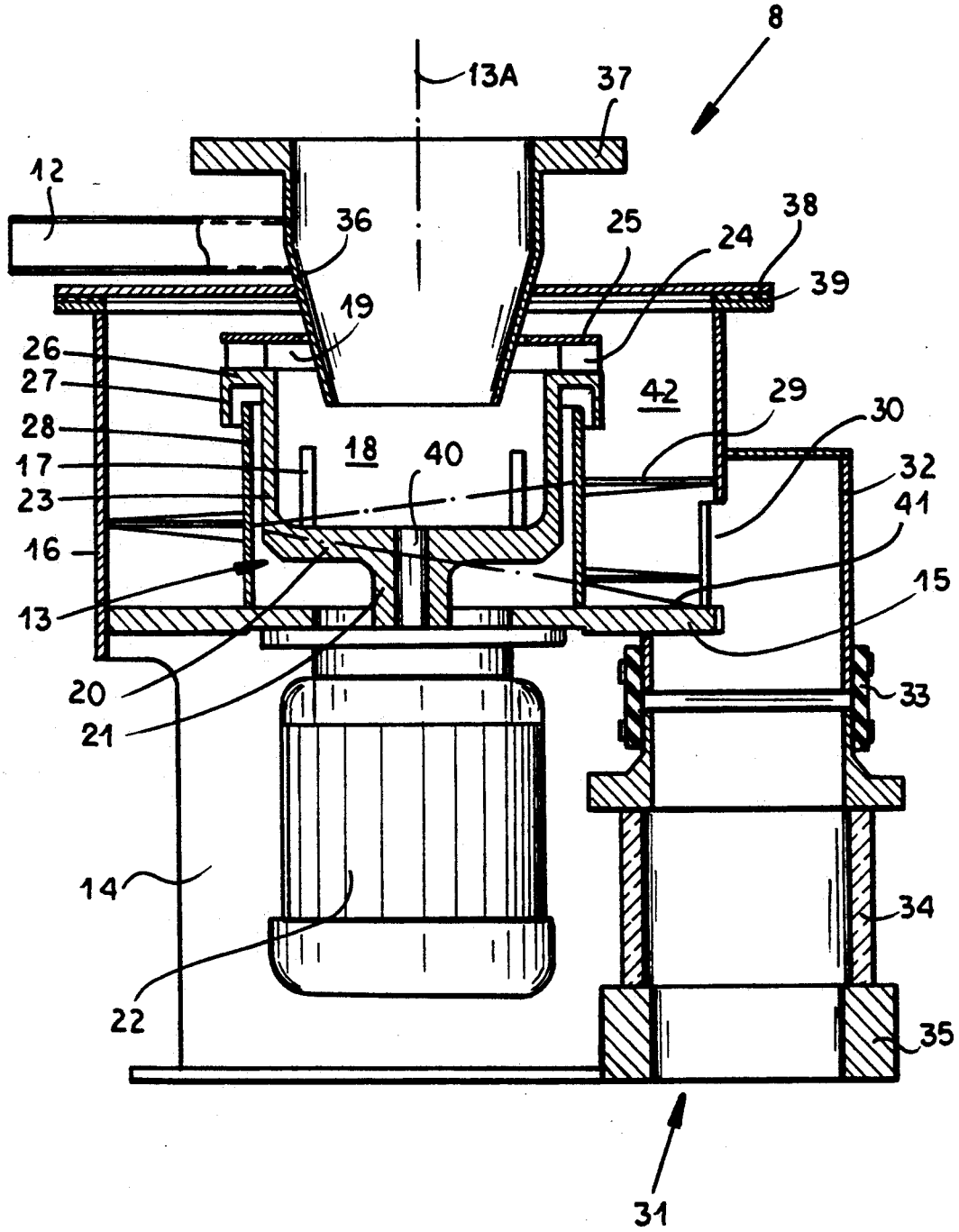
FIG. 2 is a vertical section through the homogenizer of the apparatus.

As better seen in FIG. 2 the homogenizer 8 has a lower housing part 14 and an upper part 16 separated by a horizontal floor 15, with the lower part 16 fixed to the housing 2. A motor 22 in the lower part 16 has an output shaft 40 centered on a vertical axis 13A parallel to the axis 5A and fixed to a hub 21 of a rotor 13 that is therefore rotatable about this axis 13A at high speed. The rotor 13 has a floor 20 perpendicular to the axis 13A and a side wall 23 extending upward therefrom and formed with an outwardly projecting annular rim or flange 26 from which in turn depends a cylindrical annular rim 27. Spacers 24 on the flange 26 support an annular and planar upper-end plate 25 above the flange 26 to define a radially open gap 19 between the flange 26 and the plate 25. Internally the rotor 13 is formed with radially inwardly projecting ribs 17 serving as mixers.

A cylindrical wall 28 projects Upward from the floor 15 into the downwardly open groove defined between the outer surface of the side wall 23 of the rotor 13 and the depending rim 27. This wall 28 defines With the upper housing part 16 and floor 15 an annular compartment 42 in which is provided a spiral ramp 29 and a laterally inclined deflecting plate 41 and the upper-housing wall 16 is formed at the plate 41, which is at the lowest part of the spiral 29, with an outlet port 30 opening into an outlet tube 31. This outlet tube 31 in turn is formed by an upper metallic tube 32 fixed to the housing 14, 16, and connected at its lower end by means of a rubber cuff 33 to a transparent sight glass or tube 34 whose lower end is fixed to a fitting 35 itself connected to the upper end of the tube 9 shown in FIG. 1.

The upper end of the housing 14, 16 is closed by an annular plate 38 fitted via a seal 39 to the upper annular end of the upper housing part 16 and centrally provided with a fill funnel 36 centered on the axis 13A and provided at its upper end with a flange 37 by means of which it is connected to the valve 11 of FIG. 1. The lower end of this downwardly tapering funnel 36 projects with play through the central hole of the plate 25 secured by the spacers 24 atop the rotor 13.

Thus material to be centrifuge separated is fed via the line 10 into the rotor 13 Which is rotated about the axis 13A at high speed. The liquid fraction recovered at 46 is fed in at 12 to mix with it. In the rotor 13 the mixer formations 17 break up the material which is then moved up the inside surface of the rotor 13 by centrifugal action until it is thrown radially out the opening 19 into the compartment 42. In the compartment 42 the now homogenized material flows down the ramp 29 and off the plate 41 into the tube 31 and is admitted to the upper centrifuge drum 3. Thereafter processing takes place as described in above-cited German 3,622,959.

We claim:

1. An apparatus for processing a highly viscous material, the apparatus comprising:

a centrifuge housing;

means including a homogenizer on the housing for spinning the material to reduce its viscosity to a creamy fluent consistency, the homogenizer including a homogenizer housing fixed on the centrifuge housing, a rotor rotatably about an upright axis in the homogenizer housing and including a horizontal bottom wall perpendicular to the rotor axis, an upright side wall having an upper edge, forming a downwardly open groove, and projecting upward from the bottom wall, a top wall fixed to the side wall above the upper edge thereof and forming with the upper edge a radially open slot, and mixing formations in the rotor within the side wall, and a drive motor beneath the rotor and operable to rotate the rotor about its axis, the homogenizer housing having a floor beneath the upper edge, an outer annular side wall projecting upward from the floor around the rotor, and an inner annular side wall projecting upward from the floor within the outer wall into the groove, the walls and floor together forming an annular collection compartment;

first conduit means for flowing the creamy material wholly by gravity down into an upper centrifuge stage;

means including an upper centrifuge in the centrifuge housing for separating the creamy material into a solids fraction and a liquid fraction;

second conduit means for flowing the solids fraction wholly by gravity down into a lower centrifuge stage; and means including a lower centrifuge below the upper centrifuge for centrifuging the solids fraction, a drive motor atop the housing having a downwardly projecting shaft, the upper and lower centrifuges having respective upper and lower drums fixed on the shaft.

2. The apparatus defined in claim 1 wherein the homogenizer housing further includes a spiral ramp in the compartment and having a lower end, the outer side wall being formed with an outlet port at the lower end connected to the first conduit means.

3. The apparatus defined in claim 2 wherein the first conduit means has a tube connected to the outlet port, a transparent sight glass below the tube connected to the upper centrifuge, and a rubber cuff connected between the tube and the sight glass.

4. The apparatus defined in claim 1 wherein the homogenizer housing further has an input funnel receiving the untreated material and having a downwardly tapering lower end opening into the rotor beneath the upper wall thereof, and an additive line opening tangentially into the funnel, the apparatus further comprising means for feeding a liquid into the additive line.

5. The apparatus defined in claim 4, further comprising means for recirculating the liquid fraction from the upper centrifuge to the additive line.

* * * * *

UNITED STATES PATENT AND TRADEMARK OFFICE

CERTIFICATE OF CORRECTION

PATENT NO. : 5,300,013

DATED : April 5, 1994

INVENTOR(S) : Dieter Frassdorf and Paul H. Franzen

It is certified that error appears in the above-identified patent and that said Letters Patent is hereby corrected as shown below:

Column: 3, Line: 8, "41" should read as - - 4, - -.

Signed and Sealed this

Twenty-sixth Day of July, 1994

Bruce Lehman

*Attest:*

BRUCE LEHMAN

*Attesting Officer*

*Commissioner of Patents and Trademarks*